US007225855B2

(12) United States Patent
Miyazaki et al.

(10) Patent No.: US 7,225,855 B2
(45) Date of Patent: Jun. 5, 2007

(54) MOTOR DRIVE INJECTION UNIT, DIE CAST MACHINE HAVING THE UNIT, AND MOTOR DRIVE INJECTION METHOD

(75) Inventors: Tatsuyoshi Miyazaki, Toyama (JP); Takeshi Ishikawa, Toyama (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 11/272,284

(22) Filed: Nov. 10, 2005

(65) Prior Publication Data

US 2006/0124269 A1 Jun. 15, 2006

(30) Foreign Application Priority Data

Nov. 24, 2004 (JP) ..... 2004-339190

(51) Int. Cl.
*B22D 17/08* (2006.01)
*B22D 17/12* (2006.01)

(52) U.S. Cl. ..... 164/113; 164/312; 164/316

(58) Field of Classification Search ..... 164/113, 164/312, 316–318
See application file for complete search history.

(56) References Cited

U.S. PATENT DOCUMENTS 5,482,101 A * 1/1996 Fink ..... 164/312
6,581,670 B1 * 6/2003 Fink et al. ..... 164/319

FOREIGN PATENT DOCUMENTS

JP 3-4349 1/1991
JP 6-835 1/1994

* cited by examiner

*Primary Examiner*—Kuang Y. Lin
(74) *Attorney, Agent, or Firm*—Everest Intellectual Property Law Group; Michael S. Leonard

(57) ABSTRACT

In a motor drive injection unit and a motor drive injection method, which can obtain an injection speed suitable for a molding material having fast solidifying speed as well as can securely carry out pressure keeping for a predetermined period of time while making a position of an injection piston unmovable after injection and filling are completed, a molding material in a cylinder is injected into a metal mold by converting a rotational motion of an electric servo motor into a reciprocating motion of an injection piston in the cylinder through a plunger with a ball screw, a surge pressure control means is provided for placing the injection piston in the cylinder in an unmovable state when at least a predetermined amount of a load is applied to the injection piston by the molding material in the cylinder, the surge pressure control means includes a combination of rotation control means of the electric servo motor and an upward movement suppression mechanism of the injection piston, and further, an injection speed of the injection piston is increased by providing a time difference between initial motions of the plunger and the injection piston.

7 Claims, 4 Drawing Sheets

MOTOR DRIVE INJECTION UNIT, DIE CAST MACHINE HAVING THE UNIT, AND MOTOR DRIVE INJECTION METHOD

BACKGROUND OF THE INVENTION

1. Field of the Invention

The present invention relates to an injection unit for making it possible to execute a high speed injection using an electric motor as well as to securely keep pressure after a metal mold is filled with a molding material, a die cast machine provided with the unit, and a motor drive injection method.

2. Description of the Related Art

Conventionally, in a die cast machine for injecting a molten metal material such as aluminum and zinc into a metal mold and molding it, an injection piston is ordinarily driven by hydraulic pressure because of a reason that the injection piston can be actuated at high speed and a structure is simple, and the like. For example, in a die cast machine disclosed in Japanese Utility Model Application Laid-Open (JP-U) No. 3-4349 (patent document 1), an injection piston is also driven using a hydraulic cylinder. However, the hydraulic cylinder is used in the die cast machine in order to prevent a situation that an apparatus is deformed or damaged since when a heating by a heater is stopped upon molding a molding material (molten material), which is expanded by cooling, the molten material in a holding furnace is solidified as well as the molten material in an injection cylinder is also solidified and expanded and an excessive force is applied to an injection piston in the injection cylinder. Accordingly, it is intended only to avoid a deformation or a damage of the apparatus but not to particularly exclude a disadvantage resulting from the use of the hydraulic cylinder.

That is, in the patent document 1, the hydraulic cylinder is disposed at a position just above the injection cylinder in the holding furnace through a frame, an attachment plate is fixedly provided at a lower end of a piston rod of the hydraulic cylinder, and a guide cylinder, in which a stepped hollow portion is formed, is fixed to a lower portion of the attachment plate, the stepped portion having a large diameter upper portion and a small diameter lower portion. An upper end flange portion of the injection piston rod is accommodated in the stepped hollow portion such that the upper end flange portion can move in the large diameter hollow portion thereof upward and downward, and a piston at the lower end of the injection piston rod is inserted into the injection cylinder such that the piston can move therein upward and downward. Further, a compression spring, which has repulsive force larger than an output of the hydraulic cylinder, is elastically interposed between the flange accommodated in the large diameter portion of the stepped hollow portion and the attachment plate. When the heating by the heater in the holding furnace is stopped on the way of molding, the molten material is solidified in the holding furnace, and the molten material in the injection cylinder is also solidified and expanded, the injection piston is moved upward against the repulsive force of the compression spring by the expansion pressure of the molten material. Since the upward movement of the injection piston at this time is buffered by the compression spring, the injection piston does not move abruptly and the apparatus is not damaged.

In contrast, Japanese Patent Application Laid-Open (JP-A) No. 6-835 (patent document 2), for example, discloses a transfer molding apparatus for manufacturing a molded product by injecting a thermosetting resin material into a metal mold by reciprocating an injection piston using an electric servo motor. The transfer molding apparatus is specifically configured such that a ball nut is directly coupled with a rotor of a servo motor so that it can be rotated thereby through a bearing with respect to a base member. A ball screw is threaded into the ball nut through balls. Further, the upper end of the ball screw is caused to pass through the servo motor, a spline groove is cut to the ball screw, and a spline nut unrotatably and fixedly disposed to a base member is threadingly attached to the spline groove. A plunger is coupled with the lower end of the ball screw through a load sensor. A fixed plate having a pot, in which a resin material is accommodated, is disposed below the plunger, and the lower end of the plunger is inserted into the pot so as to fit together with it and to be able to move upward and downward therein. A metal mold is disposed in confrontation with the fixed plate, and a movable plate moves to and from the metal mold.

According to the patent document 2, the rotation of the servo motor is converted into the reciprocating motion of the injection piston through the balls charged into a spiral groove without using a speed reduction mechanism. Accordingly, since a resin material can be accurately injected into the metal mold, and thrust force generated in a plunger is detected and fed back to the servo motor, no unreasonable force is applied to the resin material, no stress remains in the interior of a molded product, and no bubble is mixed with the molded product, and a resin has uniform orientation. Further, since the plunger is directly coupled with the servo motor without the speed reduction mechanism, the apparatus can be reduced in size, and the manufacturing cost thereof can be also reduced.

Incidentally, when a material having high solidifying speed is handled as particularly in die cast machines, an injection operation must be executed in a short time to prevent the material from solidifying on the way of injection, different from an ordinary synthetic resin material. For this purpose, the injecting motion of an injection piston for injecting an injection material into a metal mold must be executed as fast as possible. To obtain the high injection speed, a hydraulic drive system is employed in many cases because the injection piston can be actuated at high speed, in addition to that hydraulic drive system is simple in structure. Incidentally, when a case, in which an injection piston is directly reciprocated by an electric motor, is compared with a case, in which it is driven by hydraulic pressure, an injection time required by the former case is at least three times that required by the latter case. This is because since rotation acceleration is constant when the injection piston is driven by the electric motor different from the hydraulic drive, a considerable time is required until a desired injection speed is obtained after the electric servo motor starts rotation. As a result, conventionally, electric motors are not used to the injection drive of die cast machines and are only employed in special molding machines such as transfer molding machines for a synthetic resin material having a relatively slow solidifying speed as disclosed in the patent document 2.

In contrast, in the hydraulic drive system, although a required injection speed can be obtained promptly as described above, drive force cannot be accurately transmitted in many cases due to a change of viscosity of oil caused by a change of temperature thereof when, for example, an injection piston is driven, and further a working environment may be deteriorated by the oil. To cope with the above problems, it is strongly desired to drive an injection piston by an electric motor even in die cast machines. This is because the electric motor can actuate the injection piston promptly by securely transmitting the drive force thereof to the injection piston, and, at the same time, can accurately control the stroke of the injection piston, and can easily obtain an excellent working environment.

SUMMARY OF THE INVENTION

An object of the present invention, which was made to satisfy the above requirement, is to provide a motor drive injection unit and a motor drive injection method which can obtain an injection speed suitable for a molding material having a fast solidifying speed as in, for example, a die cast machine as well as can securely keep pressure for a predetermined period of time while making the position of an injection piston unmovable after injection and filling are completed.

A part of the above object can be achieved by providing a surge pressure control means with an injection unit which is a basic configuration of the motor drive injection unit of the present invention and injects a molding material in a cylinder into a metal mold by converting the rotational motion of an electric servo motor into the reciprocating motion of an injection piston in the cylinder so that the surge pressure control means places the injection piston in the cylinder in an unmovable state when at least a predetermined amount of a load is applied to the injection piston by the molding material in the cylinder.

The surge pressure control means is preferably composed of a combination of a rotation control means of the electric servo motor and an upward movement suppression mechanism of the injection piston. The rotation control means of the electric servo motor is preferably composed of a controller including a torque output portion for outputting an output signal according to the rotation torque of the electric servo motor and a motor drive control portion for simultaneously executing the forward/rearward rotation control and the rotation speed control of the electric servo motor according to the output signal from the output portion.

According to a preferable aspect, the upward movement suppression mechanism of the injection piston includes a ball nut member which is accommodated in a fixed housing and whose rotation is controlled by the electric servo motor, and a plunger coupled with the injection piston and having a ball screw formed thereto, the ball screw permitting the plunger to reciprocate in the axial direction of the ball nut member and prohibiting the plunger to rotate about the axis of the ball nut member, and the ball nut member includes a ball nut portion, a ball nut support portion which rotatably supports the ball nut portion and is guided in the housing so as not to rotate therein and to reciprocate in the axis line direction of the plunger together with the ball nut portion, and a spring means interposed between the housing and the ball nut support portion for urging the ball nut portion in an injecting direction by necessary spring force.

Further, another part of the object can be effectively achieved by a joint interposed between the plunger and the injection piston and fixedly disposed to an end of the plunger as well as holding the base end portion of the injection piston in a hollow portion in which the base end portion can relatively reciprocate within a necessary distance. These motor drive injection units are preferably applied to a die cast machine.

In contrast, the above object can be achieved by the basic configuration of a motor drive injection method of the present invention which injects a molding material in a cylinder into a metal mold by converting the rotational motion of an electric servo motor into the reciprocating motion of an injection piston coupled with a plunger to which a ball screw threaded into a ball nut portion is formed, the method including the steps of increasing the rotation speed of the electric servo motor to an injection speed of the injection piston, and injecting a molding material in a cylinder in a short time by increasing the initial speed of the injection piston by providing a predetermined time difference between the motion of the plunger in an injecting direction and the injecting motion of the injection piston.

Further, according to a preferable aspect of the present invention, a surge pressure control is executed to make the position of the injection piston in the cylinder unmovable on completion injecting a molding material into a metal mold by simultaneously using a motor rotation drive control based on the variation of rotation torque of the electric servo motor and an upward movement control mechanism of the injection piston so that the pressure in the metal mold is kept constant for a necessary period of time.

When, for example, the rotational motion of an electric servo motor is converted into the reciprocating motion of an injection piston in a cylinder using a ball nut and a plunger with as a ball screw, molding pressure repeatedly increases and decrease instantly on completion of filling a metal mold with a molding material. In particular, when the plunger is driven by the electric servo motor as described above, even if the electric servo motor is stopped simultaneously with the completion of filling, since the motor cannot be stopped instantly, the plunger is moved by the electric servo motor as it is in an injecting direction, thereby pressure is increased. When the pressure is increased, since an excessive load is applied to the plunger from under it, the loads intends to abruptly move the plunger upward against the rotation of the electric servo motor. As a result, the metal mold opens and burrs may be formed, or an apparatus may be damaged by the abrupt movement of the plunger.

Accordingly, in the motor drive injection apparatus as disclosed in the present invention, in which the plunger is driven by the electric servo motor, development of a means for keeping the pressure of the apparatus is a particularly important point. To cope with the above subject, the present invention is provided with the surge pressure control means for making the position of the injection piston unmovable so that the injection piston endures an excessive load instantly applied thereto when molding pressure abruptly changes at a time such as the completion of filling.

In the present invention, the combination of the drive control means of the electric servo motor and the upward movement suppression mechanism of the injection piston is used as the surge pressure control means. As to a variation of the rotation torque of the electric servo motor, a brake is applied to the electric servo motor in rotation by rotating it forward and rearward in response to the output signal from the rotation torque output portion incorporated in an electronic controller, and, at the same time, the rotation speed of the motor is controlled to thereby make the position of the injection piston in the injection cylinder unmovable.

In contrast, when the excessive load is applied to, for example, the injection piston in the infection cylinder so as to move it upward, the upward movement suppression mechanism of the injection piston issues a stop signal to the electric servo motor. However, the electric servo motor cannot stop instantly and continues rotation in the injecting direction. A reverse rotation signal is issued simultaneously with the issue of the stop signal, thereby braking force is applied to the electric servo motor. The electric servo motor continues rotation in the injection direction regardless of the braking force and increase the pressure in the injection cylinder. When the pressure exceeds preset pressure (keeping pressure), the nut support portion is pushed in a direction opposite to the injecting direction against the spring force of the spring means interposed between the housing and the nut support portion. At the time, since the ball nut portion continues forward rotation, it moves upward together with the nut support portion, thereby, as shown in a preferred aspevt of a motor drive injection method of the invention, the pressure of the injection piston, which is coupled with the plunger with the ball screw threaded into the ball nut portion, is kept for a predetermined period of time in an unmovable state.

Incidentally, the rotation speed of the electric servo motor cannot be instantly increased as described above. As a result, even if it is intended to directly drive the injection piston from an electric motor through the plunger with the ball screw as in the patent document 2, it is impossible to drive the injection piston as in a hydraulic drive system. To cope with the above problem, in the present invention, the base end portion of the injection piston is held in the hollow portion of the joint interposed between the plunger and the injection piston. When the base end portion of the injection piston is held in the hollow portion as described above, the injection piston does not move in synchronism with the movement of the plunger and follows the movement of the plunger with a predetermined time difference after the plunger begins to move. More specifically, the injection piston begins to move when a predetermined time passes after the plunger begins to move. In the present invention, the rotation speed of the electric servo motor is increased to a rotation speed necessary to injection during the time difference making use of it. As a result, as disclosed in the motor drive injection method of the present invention, the plunger begins to move downward as soon as the electric servo motor begins to rotate, and force for moving the plunger downward is not transmitted to the injection piston until the servo motor reaches a predetermined rate of revolutions. Accordingly, the injection piston is actuated at high speed from the beginning, which permits high speed injection similar to the hydraulic drive system.

Further, since the electric servo motor is employed in the present invention, not only the rate of revolutions and the rotating direction thereof can be changed but also the amount of movement of the injection piston can be digitally controlled with pinpoint accuracy from the rate of revolutions of the motor. Accordingly, no variation occurs in the amount of a molding material injected in every one shot.

DESCRIPTION OF THE PREFERRED EMBODIMENT

A typical embodiment of the present invention will be specifically explained below with reference to the drawings.

Figure 1:
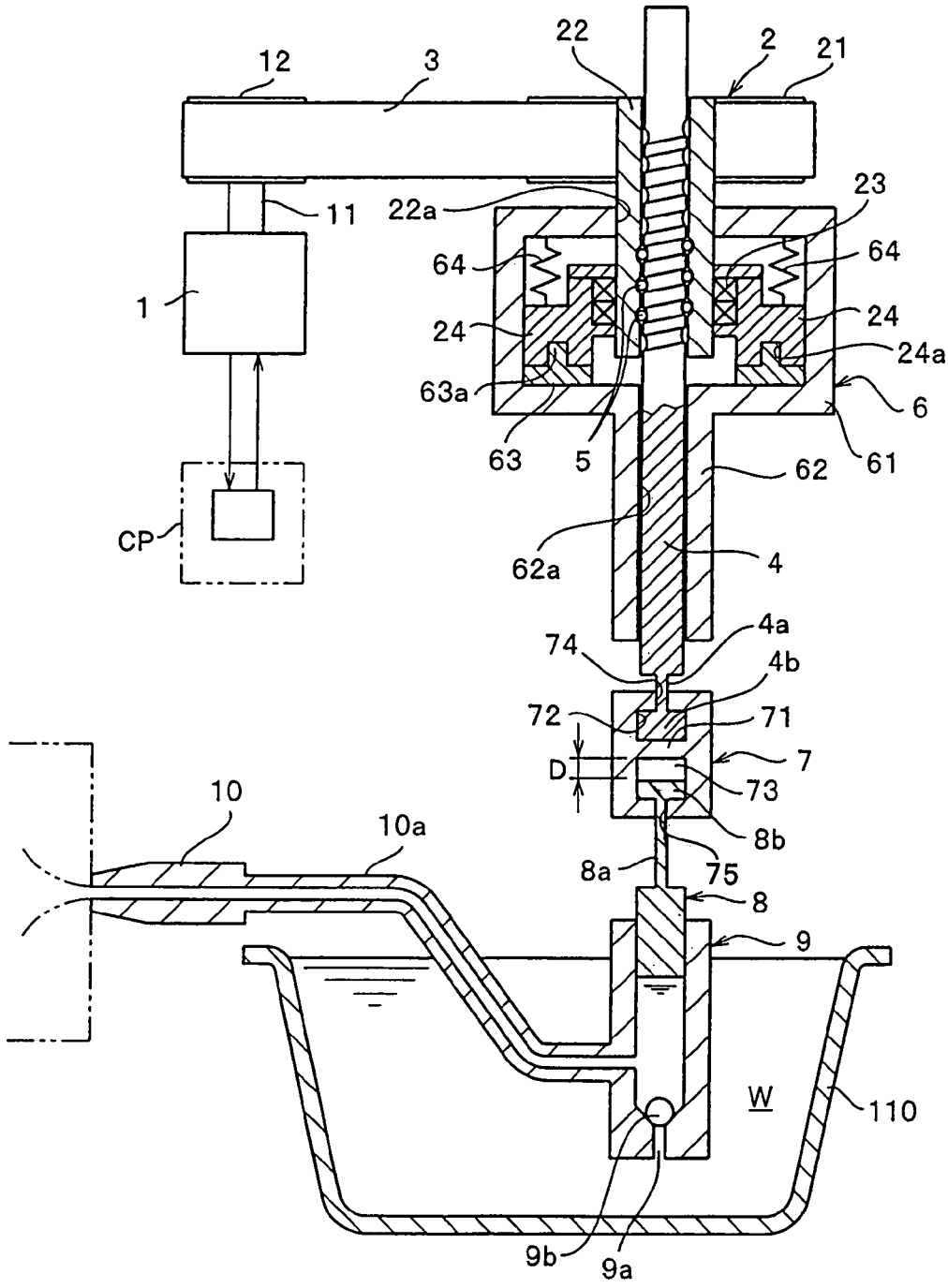
FIG. 1 is a longitudinal sectional view schematically showing a main portion of a die cast machine to which a motor drive injection unit as a typical embodiment of the invention is applied before the machine executes injection.

FIG. 1 schematically shows an overall configuration of a die cast machine having a motor drive injection unit of the invention. Note that the motor drive injection unit of the invention can be also applied to a transfer molding machine disclosed in, for example, the patent document 2 and further can be also applied to an ordinary vertical injection molding machine depending on a type of a molding material.

In FIG. 1, reference numeral 1 denotes an electric servo motor, and a first belt pulley 12 fixedly disposed to an output shaft 11 of the electric servo motor 1 is coupled with a ball nut member 2 through a belt 3. The ball nut member 2 includes a second belt pulley 21, a ball nut portion 22 whose upper end is fixedly disposed to the center of rotation of the second belt pulley 21, and a ball nut support portion 24 relatively rotatably coupled with the lower end of the ball nut portion 22 through a bearing 23 as well as moved together with the ball nut portion 22 in the rotation axis direction thereof. A plunger with a ball screw 4 is screwed into the ball nut member 2 through a plurality of balls 5. The ball nut portion 22 and the ball nut support portion 24 are supported by a housing 6 fixedly disposed to a not shown frame and the like.

The upper portion of the housing 6 is composed of a rectangular box member 61, and a vertically long cylindrical member 62 having a plunger insertion hole 62*a* projects downward from the center of the lower surface of the housing 6. A nut portion insertion hole 22*a*, into which the ball nut portion 22 is inserted, is formed at the center of the upper surface of the box member 61. In the ball nut member 2, the second belt pulley 21 is disposed above the housing 6, the ball nut portion 22 is inserted into the nut portion insertion hole 22*a* of the housing 6 as well as the ball nut support portion 24 relatively rotatably integrated with the ball nut portion 22 is accommodated in the housing 6 together with the lower end portion of the ball nut portion 22.

Although the ball nut support portion 24 of the invention can slide upward and downward with respect to the fixed housing 6, the ball nut support portion 24 itself is accommodated in the housing 6 so as not to rotate about the axis of the ball nut portion 22. Accordingly, although the ball nut portion 22 of the ball nut member 2 can rotate together with the second belt pulley 21 as well as can move upward and downward with respect to the housing 6, the ball nut support portion 24 does not rotate when the ball nut portion 22 rotates and can move in a vertical direction in the housing together with the ball nut portion 22. In the embodiment, a guide member 63 is disposed on the bottom surface of the housing 6 to prevent the rotation of the ball nut support portion 24 as well as to guide the vertical movement of the ball nut support portion 24. As shown in FIG. 1, the guide member 63 has an inverted-T-shaped vertical cross section having a projection 63*a* projecting upward, and ball nut support portion 24 in confrontation with the guide member 63 has a recessed groove 24*a* formed on the lower surface thereof so that the recessed groove 24*a* is engaged with the projection 63*a* of the guide member 63.

A compression spring 64 acting as a spring means of the present invention is interposed between the upper inner wall surface of the housing 6 and the upper surface of the ball nut support portion 24 to prevent the ball nut support portion 24 from moving upward and downward needlessly and further to permit the upward movement of the plunger 4 with the ball screw when pressure exceeding preset pressure is applied to the plunger 4 from under it. The spring force of the compression spring 64 at the time is approximately equal to the pressure kept after the completion of injection of a molding material.

Further, in the embodiment, an injection piston 8 is coupled with the lower end of the plunger 4 through a joint 7. The joint 7 is composed of a case member, and the hollow portion of the interior of the case member is partitioned to first and second hollow portions 72 and 73 through a mid partition wall 71. In contrast, a plunger lower end latch hole 74 is formed to the center of an upper wall of the joint 7 to latch and fix the lower end of the plunger 4, and a rod end engagement hole 75 is formed to the center of a lower wall of the joint 7 likewise to latch and hold the upper end of the rod of the injection piston 8. For this purpose, the plunger 4 has a flange-shaped latch portion 4*b* at the lower end thereof so that the latch portion 4*b* is latched to the plunger lower end latch hole 74 through a neck portion 4*a*, and the rod of the injection piston 8 also has a flange-shaped engagement portion 8*b* at the upper end thereof likewise so that the engagement portion 8*b* is engaged with the rod end engagement hole 75 through a neck portion 8*a*. Although the latch portion 4*b* of the plunger 4 is intimately fitted to the first hollow portion 72 of the joint 7, the engagement portion 8*b* of the injection piston 8 is loosely fitted to the second hollow portion 73 of the joint 7 while remaining a space having a predetermined length D in a vertical direction.

Accordingly, even if the ball nut portion 22 rotates and the plunger 4 with the ball screw begins to move downward, the force resulting from the downward movement of the plunger is not transmitted to the injection piston 8 until the lower surface of the mid partition wall 71 of the joint 7 is abutted against the upper surface of the engagement portion 8*b* of the injection piston 8, and the injection piston 8 begins to move downward only after the lower surface of the mid partition wall 71 of the joint 7 is abutted against the upper surface of the engagement portion 8*b*. That is, a necessary time difference is provided between the initial movement of the plunger 4 and that of the injection piston 8 by remaining the vertical space having the predetermined length D in the second hollow portion 73 of the joint 7 to permit the vertical movement of the injection piston 8.

This configuration has a very important meaning to the present invention together with the configuration between the ball nut member 2 and the housing 6.

When the electric servo motor 1 is rotated forward or rearward, the plunger 4 with the ball screw is vertically linearly moved through the ball nut member 2 driven in rotation by the electric servo motor 1. Incidentally, the rotating speed of the electric servo motor 1 is increased by predetermined acceleration. Accordingly, even if the electric servo motor 1 is directly coupled with the injection piston 8 through the ball nut and the ball screw, it is impossible to provide the injection piston 8 with a necessary injection speed from the start of actuation thereof. As a result, the injection piston 8 cannot be actuated in a predetermined stroke at high speed from the start of actuation thereof. According to the embodiment, however, since the time difference is provided between the start of actuation of the plunger with the screw 4 and that of the injection piston 8, the injection piston 8 can be actuated at high speed from the moment at which the lower surface of the mid partition wall 71 of the joint 7 is abutted against the upper surface of the engagement portion 8*b* of the injection piston 8 by increasing the rotating speed of the electric servo motor 1 to a necessary speed before the lower surface of the mid partition wall 71 of the joint 7 is abutted against the upper surface of the engagement portion 8*b* of the injection piston 8.

The injection piston 8 is slidably and intimately inserted into an injection cylinder 9 likewise an ordinary die cast machine, and an injection nozzle 10 is coupled with the injection cylinder 9 through a nozzle pipe 10*a*. In the embodiment, a molten material introduction hole 9*a* is formed to the center of the bottom of the injection cylinder 9, and a ball 9*b* having a function of an open/close valve is disposed to close the molten material introduction hole 9*a* from the inside of a cylinder chamber. With this configuration, an opening at the upper end of the injection cylinder 9 and the injection nozzle 10 disposed to the extreme end of the nozzle pipe 10*a* are exposed to the outside, and the injection cylinder 9 and the nozzle pipe 10*a* are partly dipped into and held in a molten material W in a holding furnace 110. The injection nozzle 10 is attached to a not shown frame and the attachment position thereof is made immovable, and an injection port of the injection nozzle 10 is caused to be in intimate contact with a spool portion of a not shown fixed metal mold at all times.

An injection procedure in the above configuration will be specifically explained based on FIGS. 1 to 4.

Figure 2A:
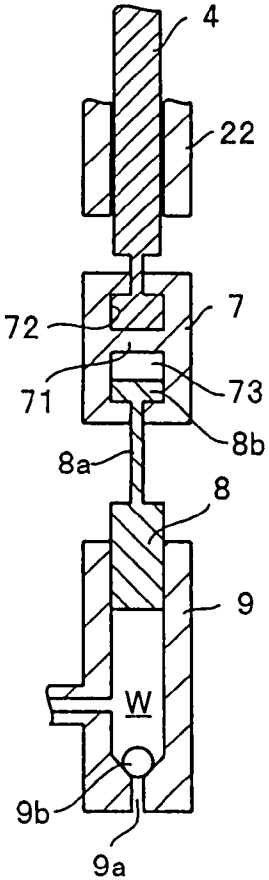
FIGS. 2A to 2E are views explaining an injection procedure executed by the motor drive injection unit.
Figure 2B:
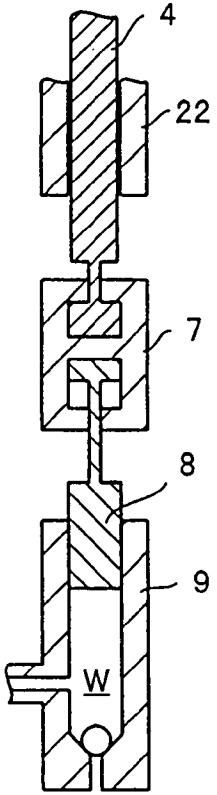
Figure 2C:
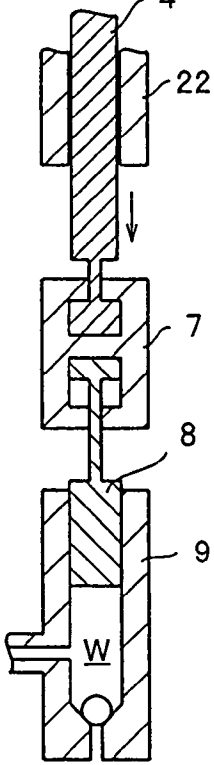

The electric servo motor 1 does not rotate, the ball nut portion 22 does not also rotate, and thus the plunger 4 with the ball screw is located at an upper end waiting position shown in FIG. 1 and FIG. 2A. In this state, when the electric servo motor 1 is rotated forward, the ball nut portion 22 is also rotated forward through the belt 3, and the plunger 4 with the ball screw begins to move downward together with the joint 7. When the plunger 4 moves downward in the hollow portion 73 of the joint 7 by the distance D, the lower surface of the mid partition wall 71 of the joint 7 is abutted against the upper surface of the engagement portion 8*b* formed to the upper end of the injection piston 8 waiting below as shown in FIG. 2B. During the period of time until the lower surface of the mid partition wall 71 of the joint 7 is abutted against the upper surface of the engagement portion 8*b* of the injection piston 8, the rate of revolutions of the electric servo motor 1 is increased such that it provides a speed, which is necessary to the injection of the injection piston 8, with the plunger 4 with the ball screw.

Figure 2D:
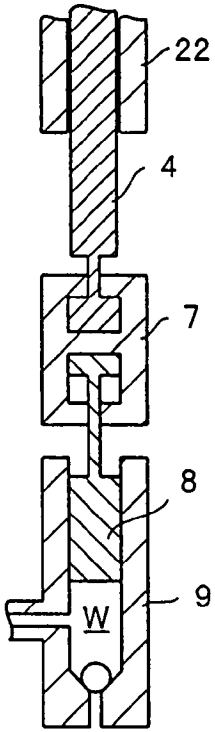

When the lower surface of the mid partition wall 71 is abutted against the upper surface of the engagement portion 8*b* of the injection piston 8, the injection piston 8 moves downward at high speed together with the plunger 4 with the ball screw from the time it starts movement and instantly reaches an injection completion position shown in FIG. 2D and fills the metal mold with the molding material. Incidentally, when an injection piston is directly driven from a ball nut portion using the same electric servo motor 1, an injection time is 35 ms. However, when the time difference is provided between the start of the plunger 4 with the ball screw and that of the injection piston 8, the injection time is reduced up to 8 ms. Accordingly, even when a molding material having very high solidifying speed such as zinc and the like is molded, the molding material is not solidified in the metal mold before it is filled with it, thereby a cavity can be securely filled with a necessary amount of the molding material.

On completion of filling the metal mold with the molding material, a stop signal is issued to the electric servo motor 1 according to a sequence previously input to a controller CP. However, even if the electric servo motor 1 is disconnected from a power supply in response to the stop signal, it is not stopped instantly and keeps forward rotation while gradually reducing its speed, and thus the injection piston 8 intends to continuously move downward. As a result, the pressure in the injection cylinder 9 instantly increases and an excessive amount of upward pressure acts on the injection piston 8. At the time, when the electric servo motor 1 is placed in a halt condition without breaking it, the pressure acting on the injection piston 8 could move the ball nut member 2 upward instantly through the plunger 4 with the ball screw against the compressive force of the compression spring 64 in the housing 6. If the injection piston moves in a direction opposite to an injecting direction when the filling is completed, pressure is not kept after the filling, thereby the metal mold may be opened or burrs may be formed.

To cope with the above problem, in the embodiment, a reversing signal is issued to the electric motor simultaneously with the issue of the stop signal on completion of filling as described above. Although the electric servo motor 1 intends to rotate reversely in response to the reversing signal, it continuously rotates forward by inertia just after the completion of filling, and braking force acts on it. As a result, the electric servo motor 1 abruptly reduces its speed. However, since the electric servo motor 1 rotates forward as ever although its speed is reduced, the injection piston 8 intends to continuously move downward, thereby pressure greater than that necessary to pressure keeping is generated in the injection cylinder 9.

Figure 2E:
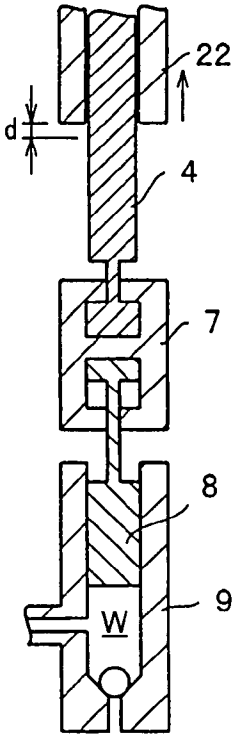
Figure 3:
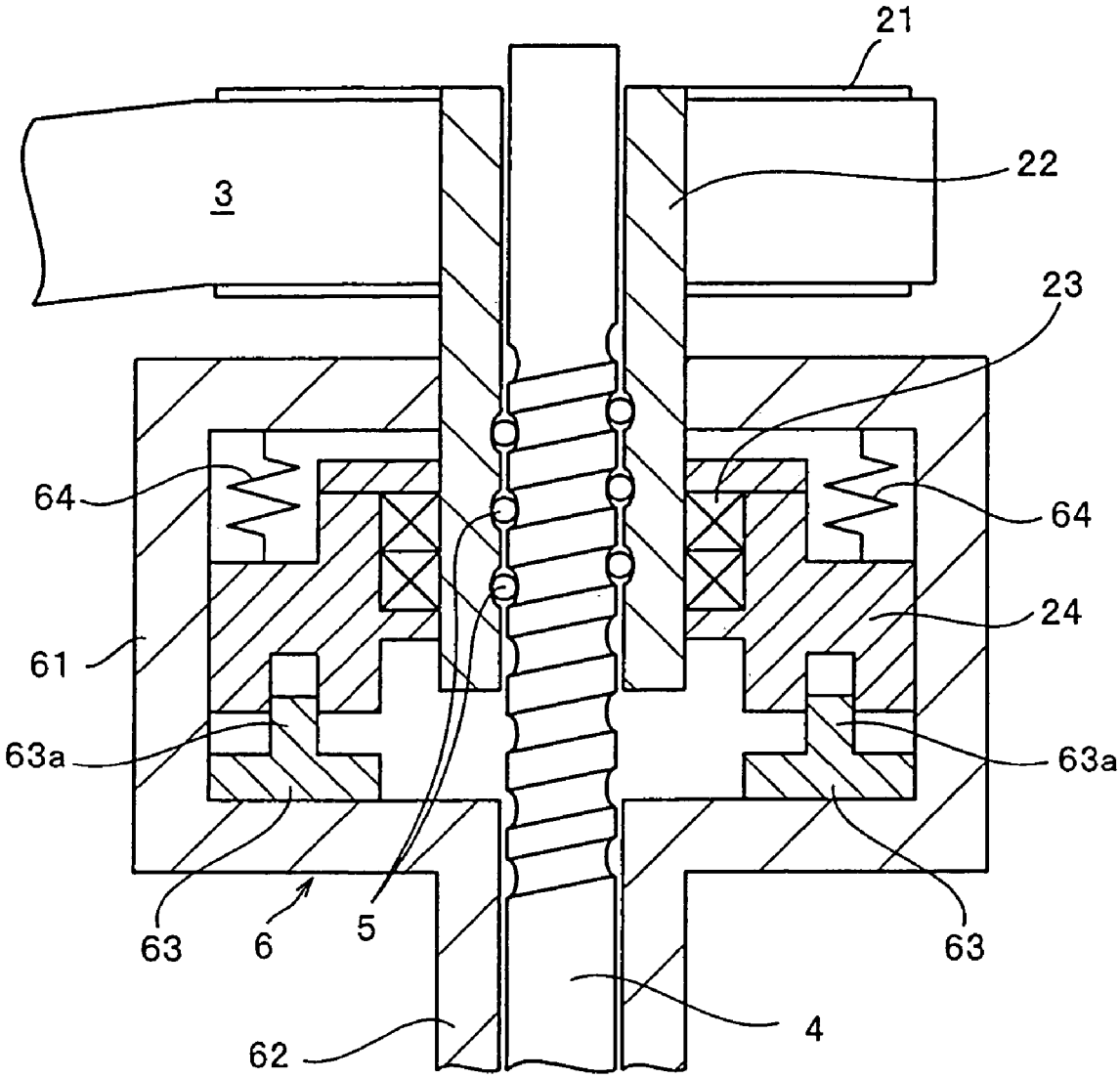
FIG. 3 is an enlarged longitudinal sectional view showing a part of a main portion of the motor drive injection unit when pressure is kept.
Figure 4:
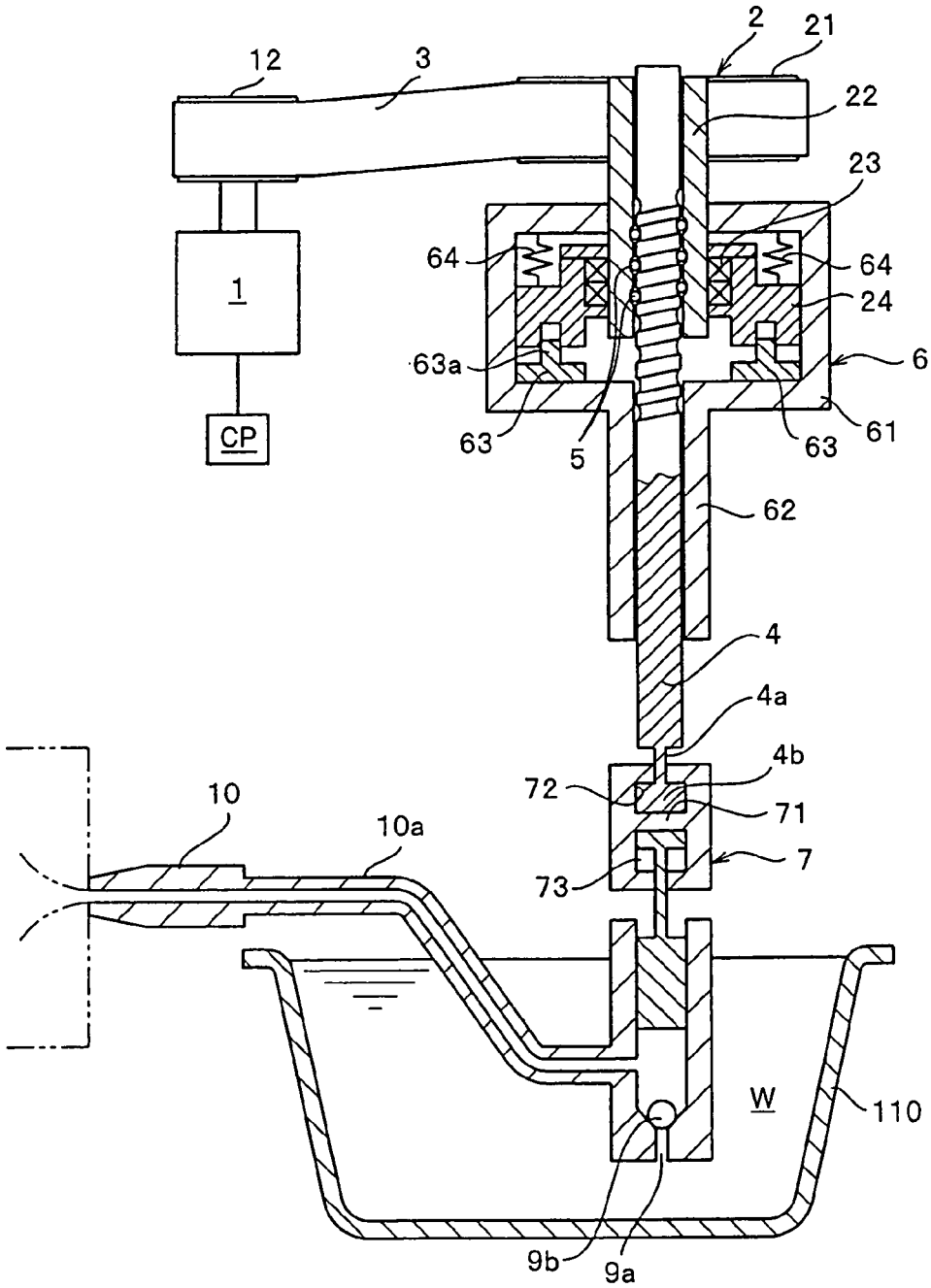
FIG. 4 is a longitudinal sectional view schematically showing the main portion of the die cast machine when pressure is kept.

In the embodiment, when the second belt pulley 21 continues forward rotation and pressure greater than that necessary to pressure keeping is generated in the injection cylinder 9 during the pressure keeping period regardless of that the electric servo motor 1 is braked by being rotated reversely as described above, the ball nut portion 22 rotates forward while stopping the injection piston 8 at a pressure keeping position and shifts upward a necessary distance d together with the ball nut support portion 24 from the fixed housing 6 against the spring force of the compression spring 64 as shown in FIGS. 2E and 3. At the same time, the second belt pulley 21 also shifts upward together with the ball nut portion 22 while bending the belt 3. However, since the second belt pulley 21 shifts in a minute amount, no disadvantage occurs to drive the belt by the electric servo motor 1.

As the ball nut portion 22 shifts, when it is detected that the pressure variation in the injection cylinder 9 is stabilized from the rotation torque value of the electric servo motor 1 before it completely stops, a forward rotation signal is issued from the controller CP to the electric servo motor 1, thereby the electric servo motor 1 is rotated again at low speed. The forward rotating operation at the time is executed to keep the pressure in the injection cylinder 9 constant and to return the ball nut member 2 to an initial position. When a predetermined pressure keeping time passes in this state, a reverse rotation signal is issued from the controller CP to the electric servo motor 1, and the electric servo motor 1 starts reverse rotation and positively rotates the ball nut portion 22 reversely through the belt 3, and the plunger 4 with the ball screw is moved upward by the distance D first. Thereafter, the injection piston 8 is moved upward up to the waiting position together with the plunger 4, thereby an injection process for one shot is completed. Subsequently, the above operation is repeated.

As described above, in the present invention, a signal is output from a torque output portion of the controller according to the rotation torque of the electric servo motor, and the forward/rearward rotation control and the rotation speed control of the electric servo motor are simultaneously executed in response to the torque output from a motor drive control portion. At the same time, when the pressure in the injection cylinder exceeds the keeping pressure, the pressure in the injection cylinder is controlled using both the rotation control means of the electric servo motor, which stops the injection piston 8 at the pressure keeping position while escaping the ball nut member upward against the spring force and keeps the pressure in the injection cylinder constant, and the upward movement suppression means of the injection piston. Accordingly, since adequate molding pressure and keeping pressure can be maintained to the molding material, not only a molded product of good quality without burrs and sink marks but also a molded product having a skin of melt better than that of a molded product made by conventional hydraulic pressure can be obtained.

What is claimed is:

1. A motor drive injection unit for injecting a molding material in a cylinder into a metal mold by converting a rotational motion of an electric servo motor into a reciprocating motion of an injection piston in the cylinder, the motor drive injection unit including surge pressure control means for placing the injection piston in the cylinder in an unmovable state when at least a predetermined amount of a load is applied to the injection piston by the molding material in the cylinder, and further comprising a plunger coupled with the injection piston and having a ball screw formed thereto, wherein a joint is interposed between the plunger and the injection piston, and the joint is fixedly disposed to an end of the plunger as well as holds a base end portion of the injection piston in a hollow portion in which the base end portion can relatively reciprocate for a necessary distance.

2. The motor drive injection unit according to claim 1, wherein the surge pressure control means includes a combination of rotation control means of the electric servo motor and an upward movement suppression mechanism of the injection piston.

3. The motor drive injection unit according to claim 2, wherein the rotation control means of the electric servo motor comprises a controller including a torque output portion for outputting an output signal according to a rotation torque of the electric servo motor and a motor drive control portion for simultaneously executing a forward/rearward rotation control and a rotation speed control of the electric servo motor according to the output signal from the torque output portion.

4. The motor drive injection unit according to claim 2, wherein the upward movement suppression mechanism of the injection piston includes:

a ball nut member which is accommodated in a fixed housing and whose rotation is controlled by the electric servo motor; wherein the ball screw permits the plunger to reciprocate in an axial direction with respect to the ball nut member and prohibits the plunger to rotate about an axis of the ball nut member, and the ball nut member includes:

a ball nut portion;

a ball nut support portion which rotatably supports the ball nut portion and is guided in the housing so as not to rotate therein and to reciprocate in an axis line direction of the plunger together with the ball nut portion; and spring means interposed between the housing and the ball nut support portion for urging the ball nut portion in an injecting direction by necessary spring force.

5. A die cast machine including the motor drive injection unit according to claim 4.

6. A motor drive injection method of injecting a molding material in a cylinder into a metal mold by converting a rotational motion of an electric servo motor into a reciprocating motion of an injection piston coupled with a plunger to which a ball screw threaded into a ball nut portion is formed, the motor drive injection method including the steps of:

increasing a rotation speed of the electric servo motor up to an injection speed of the injection piston; and injecting a molding material in a cylinder into a metal mold in a short time by increasing an initial speed of the injection piston by providing a predetermined time difference between a motion of the plunger in an injecting direction and an injecting motion of the injection piston.

7. The motor drive injection method according to claim 6, further including a step of keeping a pressure in the metal mold for a necessary period of time by executing a surge pressure control for making a position of the injection piston in the cylinder unmovable on completion of injecting the molding material into the metal mold by simultaneously using a motor rotation drive control based on a variation of rotation torque of the electric servo motor and an upward movement control mechanism of the injection piston.

* * * * *